US007796904B2

(12) United States Patent
Kwon

(10) Patent No.: US 7,796,904 B2
(45) Date of Patent: Sep. 14, 2010

(54) APPARATUS AND METHOD OF DRIVING DEVELOPING UNIT AND IMAGE FORMING APPARATUS EMPLOYING THE SAME

(75) Inventor: Jae-min Kwon, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 312 days.

(21) Appl. No.: 11/831,092

(22) Filed: Jul. 31, 2007

(65) Prior Publication Data

US 2008/0181669 A1 Jul. 31, 2008

(30) Foreign Application Priority Data

Jan. 26, 2007 (KR) ..... 10-2007-0008307

(51) Int. Cl.
*G03G 15/08* (2006.01)
*G03G 15/01* (2006.01)

(52) U.S. Cl. ..... 399/53; 399/223

(58) Field of Classification Search ..... 399/53, 399/222, 223, 226, 228, 272, 281
See application file for complete search history.

(56) References Cited

U.S. PATENT DOCUMENTS 4,958,191 A * 9/1990 Yamada et al. ..... 399/226
5,828,934 A 10/1998 Tamura et al.
5,959,709 A 9/1999 Asada et al.
2004/0183959 A1 9/2004 Ishida
2005/0040504 A1 2/2005 Kang et al.
2006/0239716 A1 * 10/2006 Kim et al. ..... 399/223

FOREIGN PATENT DOCUMENTS

| | | |
|---|---|---|
| EP | 0 410 730 | 1/1991 |
| EP | 1 715 390 | 10/2006 |
| JP | 04-162061 | 6/1992 |
| JP | 09-090754 | 4/1997 |
| JP | 11-15324 | 1/1999 |
| JP | 2003-130172 | 5/2003 |
| KR | 2004-100487 | 12/2004 |
| KR | 2006-12947 | 2/2006 |

OTHER PUBLICATIONS

European Search Report dated Jan. 7, 2008 issued in EP 07016885.1.
European Search Report dated May 9, 2008 issued in EP 08100799.9.

* cited by examiner

*Primary Examiner*—Sandra L Brase
(74) *Attorney, Agent, or Firm*—Stanzione & Kim, LLP

(57) ABSTRACT

A developing unit driving apparatus which drives a developing unit having a toner cartridge to accommodate a toner, a developing part disposed in the toner cartridge to develop the toner to a photosensitive body, and a toner supplying part provided in the toner cartridge to supply the toner to the developing part, the apparatus includes: a driving source; a first power transmitter which transmits power supplied from the driving source to the developing part; and a second power transmitter which transmits the power supplied from the driving source to the toner supplying part except when the developing part is driven.

43 Claims, 9 Drawing Sheets

APPARATUS AND METHOD OF DRIVING DEVELOPING UNIT AND IMAGE FORMING APPARATUS EMPLOYING THE SAME

CROSS-REFERENCE TO RELATED APPLICATIONS

This application claims priority from Korean Patent Application No. 10-2007-0008307, filed on Jan. 26, 2007, in the Korean Intellectual Property Office, the disclosure of which is incorporated herein by reference in its entirety.

BACKGROUND OF THE INVENTION

1. Field of the Invention

The present general inventive concept relates to an apparatus and a method of driving a developing unit and an image forming apparatus employing the same, and more particularly, to an apparatus and a method of driving a developing unit which independently controls power supplied to a developing part and a supplying part of a developing unit, and an image forming apparatus employing the same.

2. Description of the Related Art

Generally, an electrophotographic color image forming apparatus, such as a laser printer, a facsimile and a digital printer, forms an electrostatic latent image by scanning light to a photosensitive medium charged with a predetermined electric potential, develops the image with a toner of a predetermined color, and transfers and fuses the image on a printing medium to print the image.

The color image forming apparatus is divided into a single path type and a multi-path type according to a color image realization method. The multi-path type image forming apparatus includes a single light scanning unit, a charger and four developing units developing colors to print full color images by four time rotations of a photosensitive body. Thus, the multi-path type image forming apparatus consumes a four-fold of printing time than the single path type image forming apparatus. However, the multi-path type image forming apparatus employs a single light scanning unit and a single charger, thereby having a simple configuration and lowering production costs.

Referring to FIG. 1, the conventional image forming apparatus includes a photosensitive body 10 which is charged by a charger, a light scanning unit 20 which scans light to the photosensitive body 10 and forms an electrostatic latent image, and a developing unit 30 which supplies a toner to the photosensitive body 20 and develops the electrostatic latent image into a toner image.

The developing unit 30 includes first, second, third, and fourth toner cartridges 30C, 30M, 30Y and 30K which respectively accommodate cyan, magenta, yellow and black powder toner therein. The first, second, third, and fourth toner cartridges 30C, 30M, 30Y and 30K respectively include a developing part 31 which faces the photosensitive body 10 and develops a toner image, and a supplying part 35 which supplies the accommodated toner to the developer 31. The developing part 31 includes a developing roller 32 which contacts or does not contact the photosensitive body 10 to form the toner image corresponding to the electrostatic latent image formed in the photosensitive body 10, and a supplying roller 33 which supplies the toner to the developing roller 32.

The supplying part 35 supplies the toner accommodated in the first, second, third, and fourth toner cartridges 30C, 30M, 30Y and 30K to the developing part 31. The supplying part 35 includes a supplying belt (not shown) or a plurality of agitators as shown in FIG. 1.

To develop the image to the photosensitive body 10 through the first, second, third, and fourth toner cartridges 30C, 30M, 30Y and 30K, the developing roller 32 of the toner cartridge corresponding to a single color contributes to development every time the photosensitive body 10 rotates one time. Thus, the first, second, third, and fourth toner cartridges 30C, 30M, 30Y and 30K are sequentially driven while the photosensitive body 10 rotates four times, to realize a full color image.

Referring to FIG. 2, the conventional developing unit driving apparatus includes first and second driving sources 41 and 45, a cam shaft 50 which is rotatably driven by the first driving source 41 and has first, second, third, and fourth cams 51, 52, 53 and 54 in a circumference thereof, a coupler 60 which is selectively coupled depending on a position of the first, second, third, and fourth cams 51, 52, 53 and 54, and a driving gear 70 which is engaged with the first, second, third, and fourth toner cartridges 30C, 30M, 30Y and 30K to transfer power.

The first, second, third, and fourth cams 51, 52, 53 and 54 are formed in different cam profiles. Thus, if one cam operates to supply power through the coupler 60, the others are driven to cut off power. For example, if the cam shaft 50 is provided as shown in FIG. 2, the third cam 53 is driven to couple the coupler 60, thereby rotatably driving a third driving gear 73 (to be described later). In this case, the first, second and fourth cams 51, 52 and 54 are positioned not to couple the coupler 60.

The coupler 60 includes a first clutch 61 which is rotatably driven by the second driving source 45 and slides in a shaft direction, a second clutch 65 which adheres to the first clutch 61 in the shaft direction to be selectively engaged with the first clutch 61 depending on a rotating position of the first, second, third, and fourth cams 51, 52, 53 and 54, and an elastic member 67 which is disposed between the first and second clutches 61 and 65 to bias the first clutch 61 elastically.

The first and second clutches 61 and 65 are provided in plural to correspond to the first, second, third, and fourth cams 51, 52, 53 and 54 in respective colors, thereby supplying power to the first, second, third, and fourth toner cartridges 30C, 30M, 30Y and 30K.

The first clutch 61 includes a first coupler 61*a* which is coupled with the second clutch 65, and a push cap 61*b* which selectively contacts one of the first, second, third, and fourth cams 51, 52, 53 and 54 to push the first coupler 61*a* to the second clutch 65.

The second clutch 65 includes a shaft 65*a* which is rotatably provided in a frame, and a second coupler 65*b* which is coupled with the first coupler 61*a*.

The driving gear 70 is formed in the same axis as the shaft 65*a* and includes first, second, third, and fourth driving gears 71, 72, 73 and 74 which are engaged with the first, second, third, and fourth toner cartridges 30C, 30M, 30Y and 30K to supply power. Thus, the respective toner cartridges 30C, 30M, 30Y and 30K are driven by the power supplied by the developing unit driving apparatus.

The conventional developing unit driving apparatus includes a single power-supplying configuration for each of the toner cartridges 30C, 30M, 30Y and 30K.

For example, the first toner cartridge 30C is driven by the power supplied through the first driving gear 71. The first toner cartridge 30C does not have an additional power-supplying configuration therein. When the power is transferred to the first toner cartridge 30C through the first driving gear 71, the power is first supplied to the developing roller 32. The supplying roller 33 and the supplying part 35 are rotatably driven by moving together with the rotation of the developing roller 32. The developing roller 32, the supplying roller 33 and the supplying part 35 are driven at the same time to develop the image and supply the toner, thereby forming an image through the first toner cartridge 30C.

In this case, vibration occurs as the supplying part 35 is driven during a developing process, thereby possibly lowering an image quality.

Also, it is difficult to secure to timely supply a developer as the time for agitating the toner is confined to the developing driving time of the toner cartridge.

SUMMARY OF THE INVENTION

The present general inventive concept provides an apparatus and a method of driving a developing unit which provides a driving timing of a developing part and a driving time of a supplying part of a toner cartridge to minimize vibration during a developing process, and an image forming apparatus employing the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a developing unit driving apparatus which drives a developing unit having a toner cartridge to accommodate a toner, a developing part disposed in the toner cartridge to develop the toner to a photosensitive body, and a toner supplying part provided in the toner cartridge to supply the toner to the developing part, the apparatus comprising a driving source, a first power transmitter which transmits power supplied from the driving source to the developing part, and a second power transmitter which transmits the power supplied from the driving source to the toner supplying part except when the developing part is driven.

The foregoing and/or other aspects and utilities of the present general inventive concept can also be achieved by providing a method of driving a developing unit which comprises a toner cartridge accommodating a toner, a developing part disposed in the toner cartridge to develop the toner to a photosensitive body, and a toner supplying part disposed in the toner cartridge to supply the toner to the developing part, the method comprising driving the developing part and cutting off the power supplied to the toner supplying part if a developing process is performed through the developing unit, and transmitting the power to and drive the toner supplying part except when the developing part is driven.

The foregoing and/or other aspects and utilities of the present general inventive concept can also be achieved by providing an image forming apparatus, comprising a photosensitive body which forms an electrostatic latent image, a light scanning unit which scans light beam to form the electrostatic latent image in the photosensitive body, a developing unit which comprises a toner cartridge to accommodate a toner, a developing part disposed in the toner cartridge to supply the toner to the photosensitive body, and a toner supplying part disposed in the toner cartridge to supply the toner in the developing part direction, a developing unit driving apparatus having a driving source, a first power transmitter which transmits power supplied from the driving source to the developing part, and a second power transmitter which transmits the power supplied from the driving source to the toner supplying part except when the developing part is driven, a transfer unit which transfers a toner image formed in the photosensitive body to a printing medium, and a fusing unit which fuses the image transferred to the printing medium.

The foregoing and/or other aspects and utilities of the present general inventive concept can also be achieved by providing a developing unit driving method of a developing unit driving apparatus usable with an image forming apparatus, the method including transmitting power supplied from a driving source to a developing part using a first transmitter, and transmitting the power supplied from the driving source to a toner supplying part using a second transmitter so as to supply the toner to the developing unit except when the developing part is driven by the first power transmitter.

The foregoing and/or other aspects and utilities of the present general inventive concept can also be achieved by providing a developing unit driving apparatus usable with an image forming apparatus, the apparatus including a developing part to supply a toner to form an image, a toner supply part to supply the toner to the developing part, and a driving unit to selectively drive the toner supplying part according to an operation position of the developing part.

The foregoing and/or other aspects and utilities of the present general inventive concept can also be achieved by providing a developing unit driving apparatus usable with an image forming apparatus, the apparatus including a driving source, a developing part to supply a toner to form an image, a toner supply part to supply the toner to the developing part, a first cam disposed between the driving source and the developing part to drive the developing part, and a second cam disposed between the driving source and the toner supply part to selectively drive the toner supply part according to a position of the first cam with respect to the developing part.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
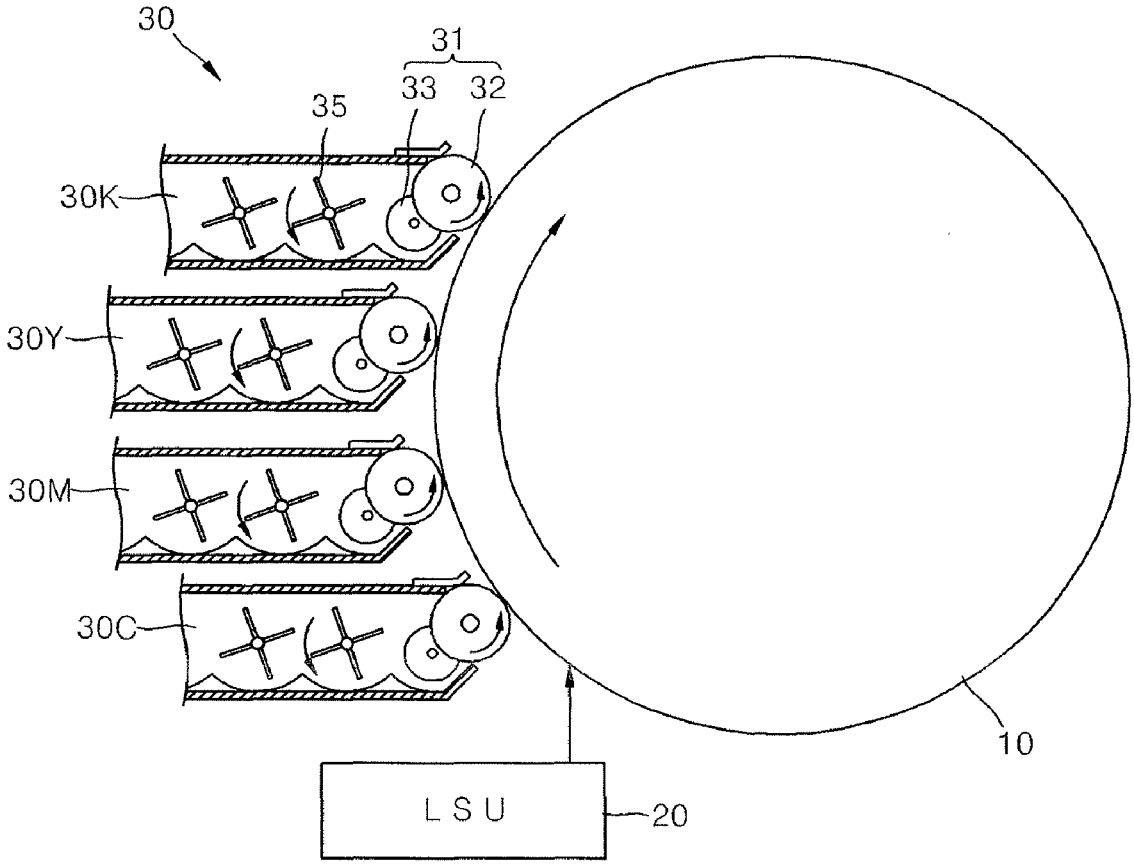
FIG. 1 (PRIOR ART)
FIG. 1 illustrates a conventional image forming apparatus.
Figure 2:
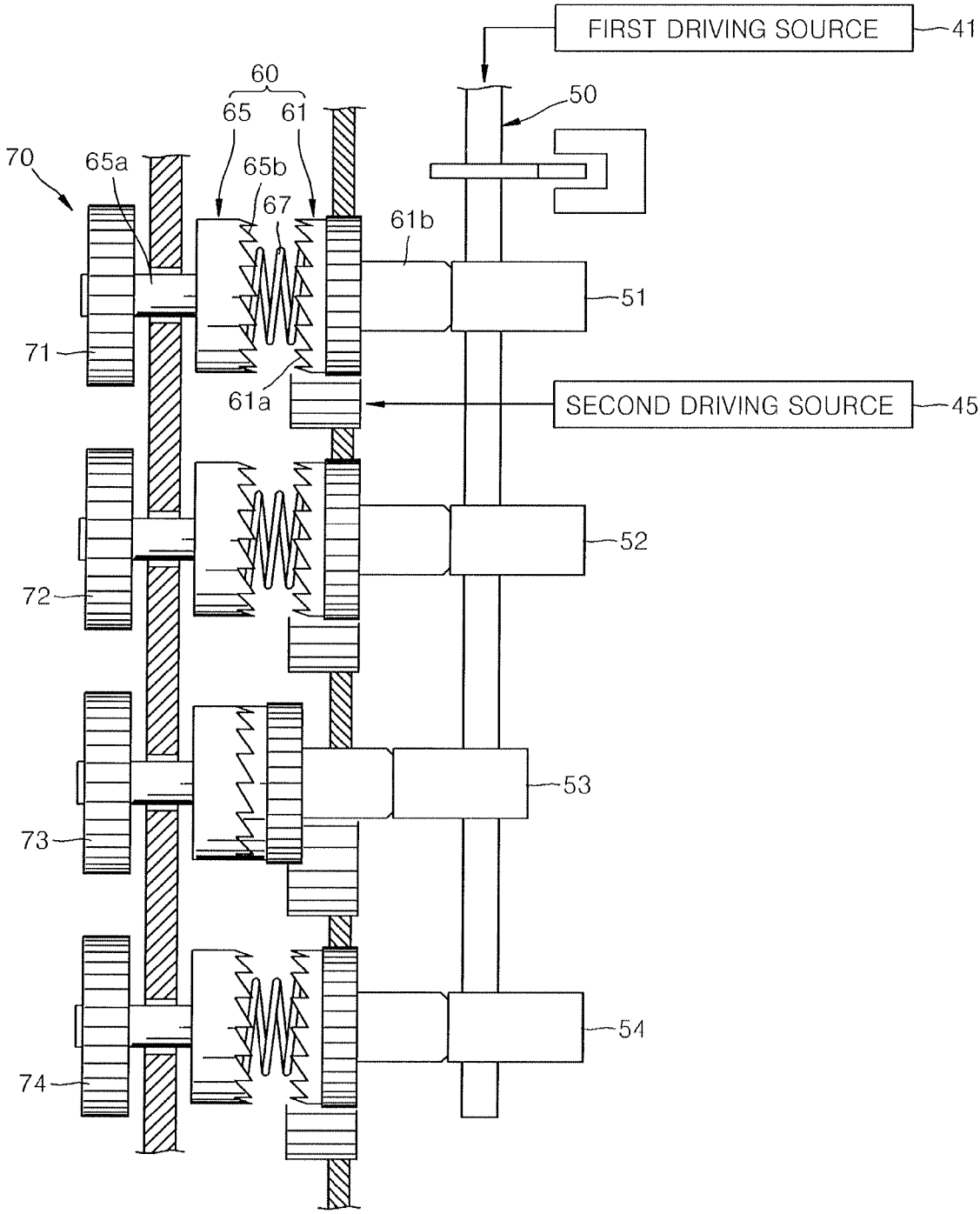
FIG. 2 (RELATED ART)
FIG. 2 is a schematic view illustrating a conventional developing unit driving apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
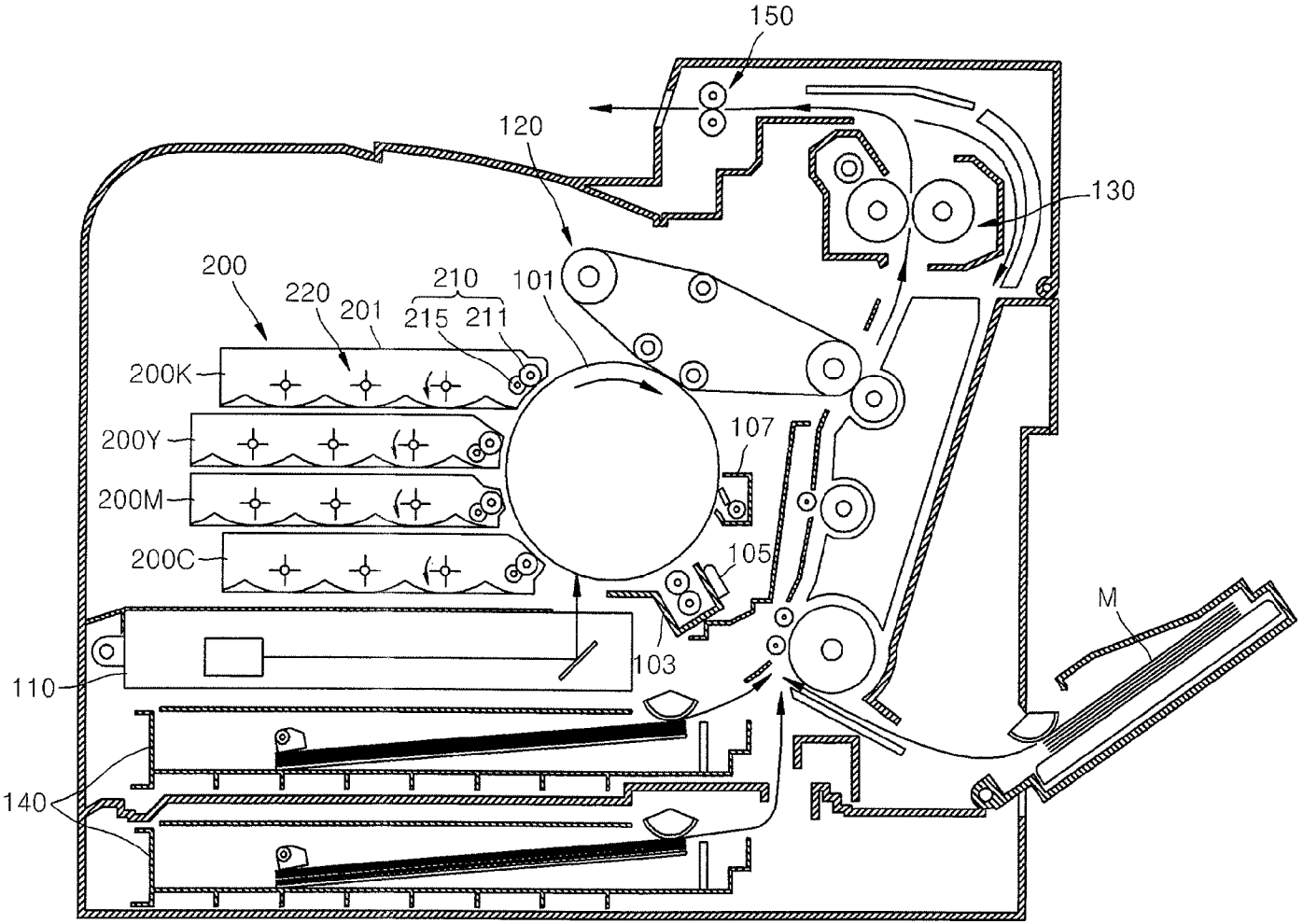
FIG. 3 is a schematic view illustrating an image forming apparatus according to an exemplary embodiment of the present general inventive concept.

Referring to FIG. 3, an image forming apparatus according to the exemplary embodiment of the present general inventive concept includes a multi-path type electrophotographic color image forming apparatus. The image forming apparatus includes a photosensitive body 101, a light scanning unit 110, a developing unit 200, a developing unit driving apparatus 300 (refer to FIG. 6), a transfer unit 120, and a fusing unit 130.

The photosensitive body 101 forms an electrostatic latent image by a light beam scanned by the light scanning unit 110.

The developing unit 200 develops the electrostatic latent image into a toner image by supplying a toner to the photosensitive body 101. The developing unit 200 includes a toner cartridge 201 which accommodates a toner therein, a developing part 210 which is provided in the toner cartridge 201 to supply the toner to the photosensitive body 101 to develop an image of the photosensitive body 101, and a toner supplying part 220 which is provided in the toner cartridge 201 to supply the toner to the developing part 210.

Figure 6:
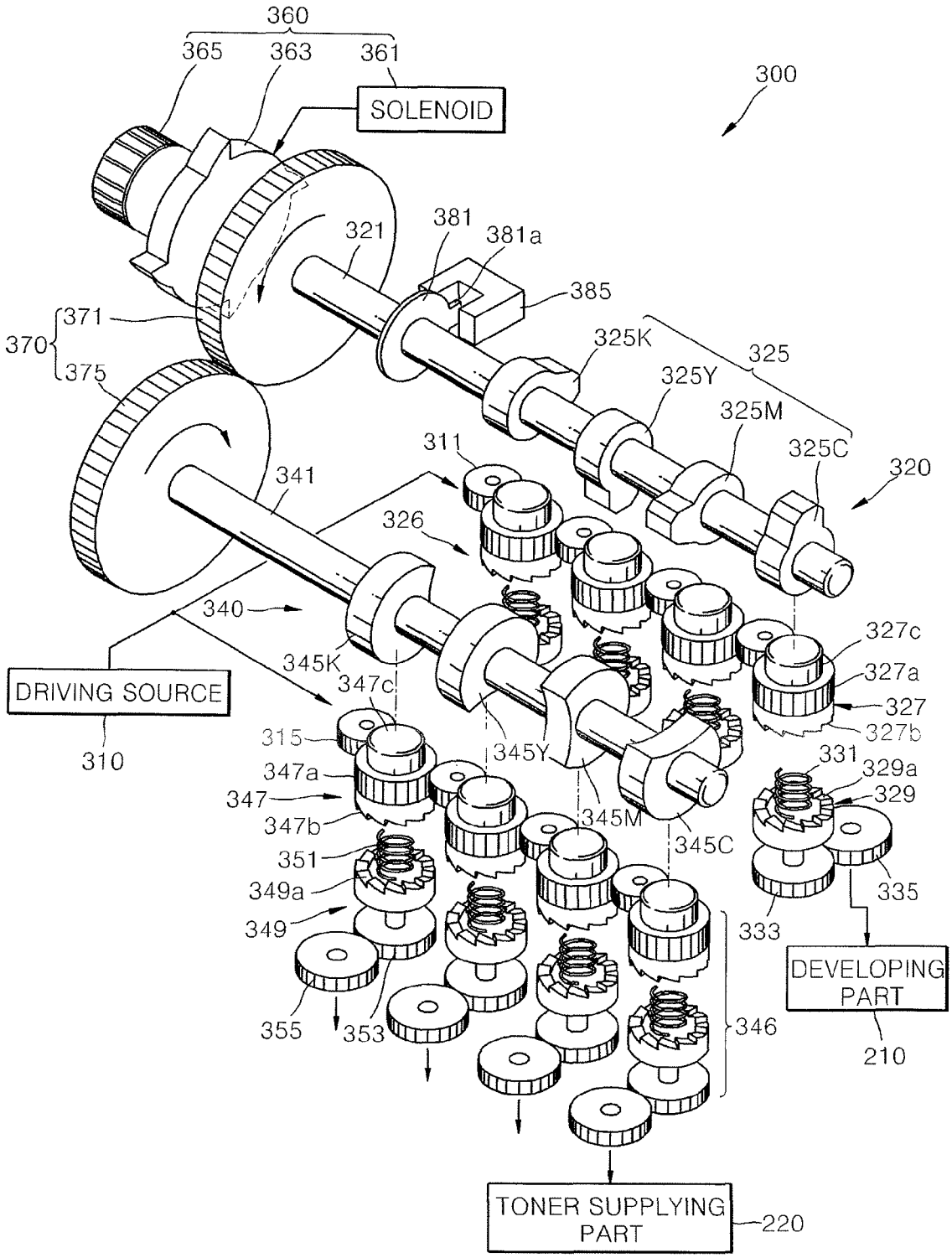
FIG. 6 is an exploded perspective view illustrating a developing unit driving apparatus of the image forming apparatus of FIG. 3.

The developing unit driving apparatus 300 drives the developing unit 200. As shown in FIG. 6, the developing unit driving apparatus 300 includes a driving source 310, a first power transmitter 320 which transmits power from the driving source 310 to the developing part 210, and a second power transmitter 340 which transmits the power from the driving source 310 to the toner supplying part 220. The first and second power transmitters 320 and 340 have a configuration to be driven at a different time to drive the developing part 210 and the toner supplying part 220 provided in a single cartridge 201. The detailed configuration of the developing unit 200 and the developing unit driving apparatus 300 will be described later.

Referring back to FIG. 3, the transfer unit 120 receives the toner image developed on the photosensitive body 101 and transfers the toner image to a printing medium M. The toner image which is sequentially formed in the photosensitive body 101 in various colors is sequentially transferred and overlaps to form a color image.

The fusing unit 130 fuses the image which is transferred to the printing medium M by the transfer unit 120.

The multi-path type color image forming apparatus includes a charger 103 which charges the photosensitive body 101 with a predetermined electric potential, a charge eraser 105 which erases an electric charge remaining in the photosensitive body 101, and a cleaning unit 107 which removes impurities from the photosensitive body 101. The color image forming apparatus further includes a medium supplying unit 140 which supplies the printing medium M, and a medium discharging unit 150 to discharge the printing medium M on which a fusing process has been completed.

Hereinafter, the developing unit 200 and the developing unit driving apparatus 300 will be described in detail.

As illustrated in FIG. 3, the developing unit 200 includes the toner cartridge 201 which accommodates the toner of a predetermined color, and the developing part 210 and the toner supplying part 220 which are provided in the toner cartridge 201.

The developing unit 200 may include a plurality of developing units which is provided in respective colors. FIG. 3 illustrates the developing unit 200 which includes first, second, third, and fourth developing units 200C, 200M, 200Y and 200K. The first, second, third, and fourth developing units 200C, 200M, 200Y and 200K respectively accommodate cyan, magenta, yellow and black toner therein. The first, second, third, and fourth developing units 200C, 200M, 200Y and 200K respectively have the developing part 210 and the toner supplying part 220 therein.

To develop the image in the photosensitive body 101 through the first, second, third, and fourth developing units 200C, 200M, 200Y and 200K, only the developing part 210 of the first, second, third, and fourth developing units 200C, 200M, 200Y and 200K corresponding to a single color contributes to developing every time the photosensitive body 101 rotates once. The first, second, third, and fourth developing units 200C, 200M, 200Y and 200K are sequentially driven to realize a full-color image while the photosensitive body 101 rotates four times.

Figure 4:
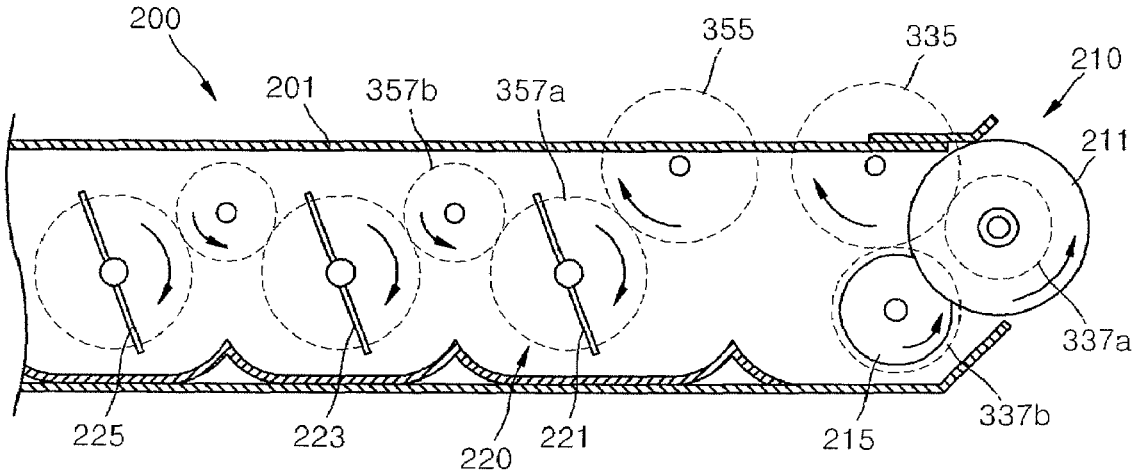
FIG. 4 is a schematic view illustrating a supplying part and a power-supplying configuration according to the exemplary embodiment of the present general inventive concept.

The developing part 210 is driven by the developing unit driving apparatus 300 and supplies the toner to the photosensitive body 101 to develop an image thereof. The developing part 210 includes a developing roller 211 which contacts or does not contact the photosensitive body 101 to form the toner image corresponding to the electrostatic latent image formed in the photosensitive body 101, and a supplying roller 215 which supplies the toner to the developing roller 211. The developing roller 211 and the supplying roller 215 are driven by power transmitted by the first power transmitter 320. To this end, as shown in FIG. 4, the toner cartridge 201 includes rotating gears 337*a* and 337*b* which rotate around a rotating axis of the developing roller 211 and the supplying roller 215. The respective rotating gears 337*a* and 337*b* are rotatably driven by the power supplied by the driving source 310 (refer to FIG. 6) through a first driver 333 and a first interlocking gear 335 (refer to FIG. 6).

Figure 5:
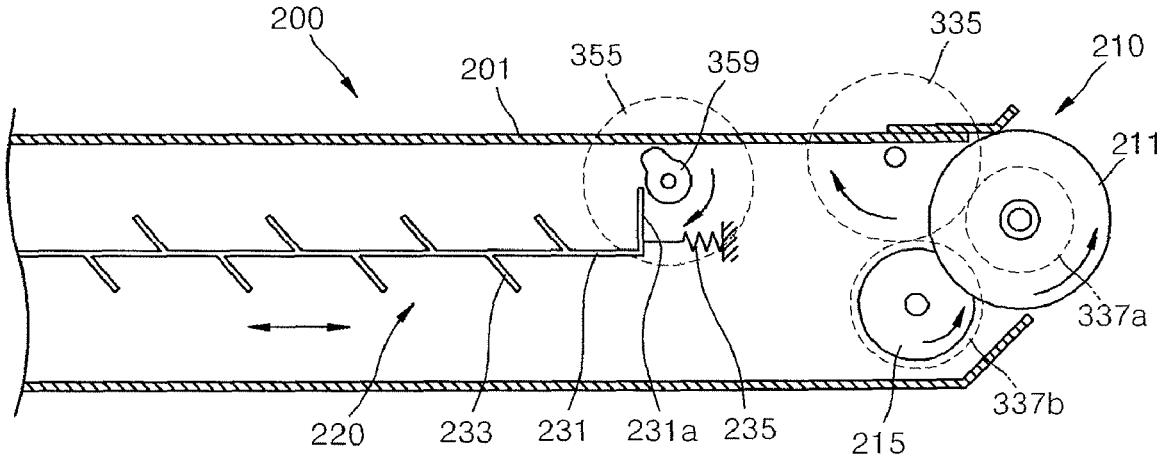
FIG. 5 is a schematic view illustrating a supplying part and a power-supplying configuration according to another exemplary embodiment of the present general inventive concept.

The toner supplying part 220 supplies the toner accommodated in the cartridge 201 to the developing part 210, and may have a configuration as shown in FIGS. 4 and 5.

As illustrated in FIG. 4, the toner supplying part 220 according to the exemplary embodiment of the present general inventive concept includes a plurality of agitators 221, 223 and 225 which is provided in the toner cartridge 201. The agitators 221, 223 and 225 may rotate around a rotating axis and supply the toner accommodated in the toner cartridge 201 to the developing part 210 while being rotatably driven. The agitators 221, 223 and 225 are driven by the power transmitted by the second power transmitter 340 (to be described later). The toner cartridge 201 has a plurality of rotating gears 357*a* which rotates around the rotating axis of the respective agitators 221, 223 and 225 and a transmitting gear 357*b* which is provided between the plurality of rotating gears 357*a* to transmit the power. The rotating gear 357*a* which is provided in the agitator 221 is rotatably driven by the power supplied by the driving source 310 through a second driver 353 and a second interlocking gear 355 (refer to FIG. 6). Here, the driving gear 353 and the rotating gear 357*a* may be directly engaged with each other without the interlocking gear 355.

As illustrated in FIG. 5, a toner supplying part 220 according to another exemplary embodiment of the present general inventive concept includes an agitating plate 231 which reciprocates within a toner cartridge 201, and an elastic member 235 which elastically biases the agitating plate 231. A plurality of supplying blades 233 is formed in the agitating plate 231 to supply a toner accommodated in the toner cartridge 201 to a developing part 210 if the agitating plate 231 reciprocates. The developing part 210 of FIGS. 4 and 5 may be similar to each other. Thus, detail descriptions thereof will be omitted.

The agitating plate 231 is driven by the power supplied by a second power transmitter 340 (to be described later). To this end, the toner cartridge 201 includes a cam member 359 which is rotated by an interlocking gear 355 engaged with the driving gear 353 to be rotatably driven, and a pushing part 231*a* which is formed in the agitating plate 231 and is selectively interfered by the cam member 359 to push the agitating plate 231 in a direction to increase an elastic force of the elastic member 235. The agitating plate 231 reciprocates by the interference between the cam member 359 and the pushing part 231*a*, and the restoring force of the elastic member 235, thereby supplying the toner.

Referring to FIGS. 6 to 9, the developing unit driving apparatus 300 according to the exemplary embodiment of the present general inventive concept includes the driving source 310, and the first and second power transmitters 320 and 340 which transmit the power from the driving source 310.

The first power transmitter 320 transmits the power from the driving source 310 to the developing part 210. The first power transmitter 320 includes a first cam shaft 321 which has a cam 325 in a circumference thereof, a first coupler 326 which is selectively coupled according to a profile of the cam 325, and the first driver 333 which drives the developing part 210. The profile of the cam 325 has a circular portion 325*a* and a projection portion 325*b* projecting from a portion of the circular portion 324*a* and having a radius greater than the circular portion 325*a*.

The cam 325, the first coupler 326 and the first driver 333 may be provided in a single or in plural depending on the configuration of the image forming apparatus which employs the cam 325, the first coupler 326 and the first driver 333. As shown in FIG. 3, if the image forming apparatus includes the first, second, third, and fourth developing units 200C, 200M, 200Y and 200K, there are provided four sets of the cams 325, first couplers 326 and first drivers 333, respectively. The cams 325, the first couplers 326 and the first drivers 333 are provided at positions corresponding to the first, second, third, and fourth developing units 200C, 200M, 200Y and 200K. In this case, the first power transmitter 320 transmits the power to the first, second, third, and fourth developing units 200C, 200M, 200Y and 200K in a predetermined sequence. If an image forming apparatus includes a single developing unit, there is provided each one of the cam 325, the first coupler 326 and the first driver 333.

Hereinafter, description will be given for the exemplary case of the configuration of the image forming apparatus in FIGS. 3 and 6.

Here, the cam 325 which is formed in the circumference of the first cam shaft 321 includes a plurality of cams, e.g., first, second, third, and fourth cams 325C, 325M, 325Y and 325K. The first coupler 326 is selectively coupled according to a corresponding position of the first, second, third, and fourth cams 325C, 325M, 325Y and 325K to transmit the power.

Figure 8:
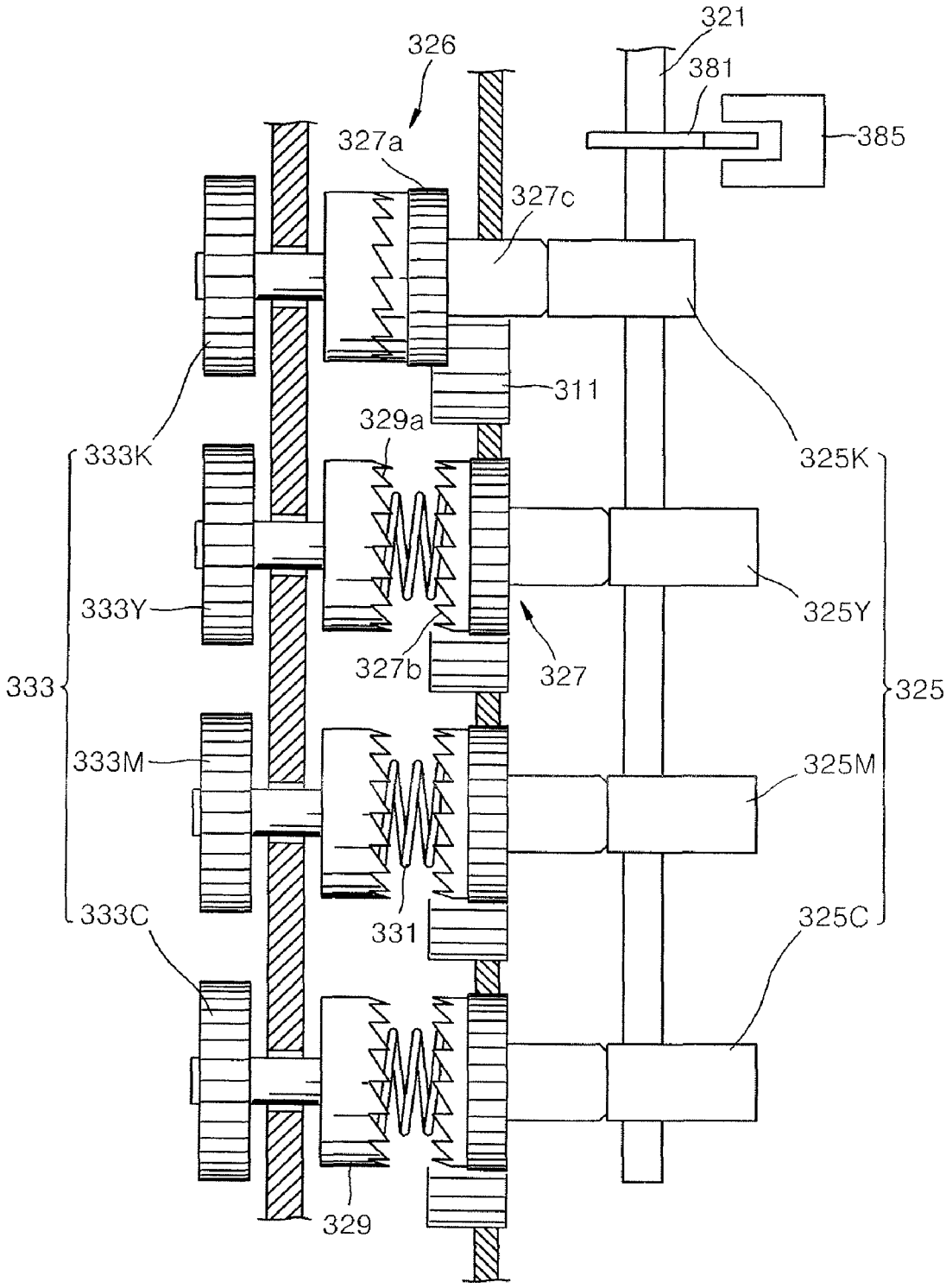
FIG. 8 is a schematic view illustrating a first power transmitter in FIG. 6.

The first, second, third, and fourth cams 325C, 325M, 325Y and 325K are formed with different cam profiles. If one cam operates to transmit the power through the first coupler 326, the others operate to cut off the power. If the first cam shaft 321 is provided as shown in FIG. 8, the fourth cam 325K is positioned to couple the first coupler 326. Then, a first driver 333K (to be described later) is rotatably driven. In this case, the first, second and third cams 325C, 325M and 325Y are positioned not to couple the first coupler 326.

The first driver 333 is provided between the first coupler 326 and the developing part 210, and drives the developing part 210 by the power from the driving source 310 through the first coupler 326 if the first coupler 326 is coupled.

The second power transmitter 340 transmits the power from the driving source 310 to the toner supplying part 220. The second power transmitter 340 includes a second cam shaft 341 which has cams 345 in a circumference thereof, a second coupler 346 which is selectively coupled according to a profile of the cam 345, and the second driver 353 which drives the toner supplying part 220. The profile of the cam 345 includes a curved (circular) surface 345*a* and a concave portion 345*b* recessed from a portion of the curved surface 345*a* to have a radius from a rotation axis thereof greater than the curved surface 345*a*.

The second driver 353 is provided between the second coupler 346 and the toner supplying part 220, and drives the toner supplying part 220 by the power from the driving source 310 through the second coupler 346 if the second coupler 346 is coupled.

The cam 345 formed in the second cam shaft 341, the second coupler 346, and the second driver 353 may be provided in a single or in plural depending on a configuration of an image forming apparatus which employs the cam 345, the second coupler 346, and the second driver 353. As illustrated in FIG. 3, if the image forming apparatus includes the first, second, third, and fourth developing units 200C, 200M, 200Y and 200K, there are provided four sets of cams 345 formed in the second cam shaft 341, second couplers 346, and second drivers 353, respectively. The cams 345, the second couplers 346, and the second drivers 353 are provided at positions corresponding to the plurality of developing units 200C, 200M, 200Y and 200K. In this case, the second power transmitter 340 transmits the power to the respective toner supplying parts 220 of the first, second, third, and fourth developing units 200C, 200M, 200Y and 200K in a predetermined sequence. If a single color image forming apparatus includes a single developing unit 200, there may be provided each of a cam 345, a second coupler 346, and a second driver 353.

Hereinafter, description will be given for the exemplary case of the configuration of the image forming apparatus shown in FIG. 3.

The cam 345 which is formed in the circumference of the second cam shaft 341 includes a plurality of cams, e.g., fifth, sixth, seventh, and eighth cams 345C, 345M, 345Y and 345K. The second coupler 346 is selectively coupled according to a corresponding position of the fifth, sixth, seventh, and eighth cams 345C, 345M, 345Y and 345K to transmit the power.

Figure 9:
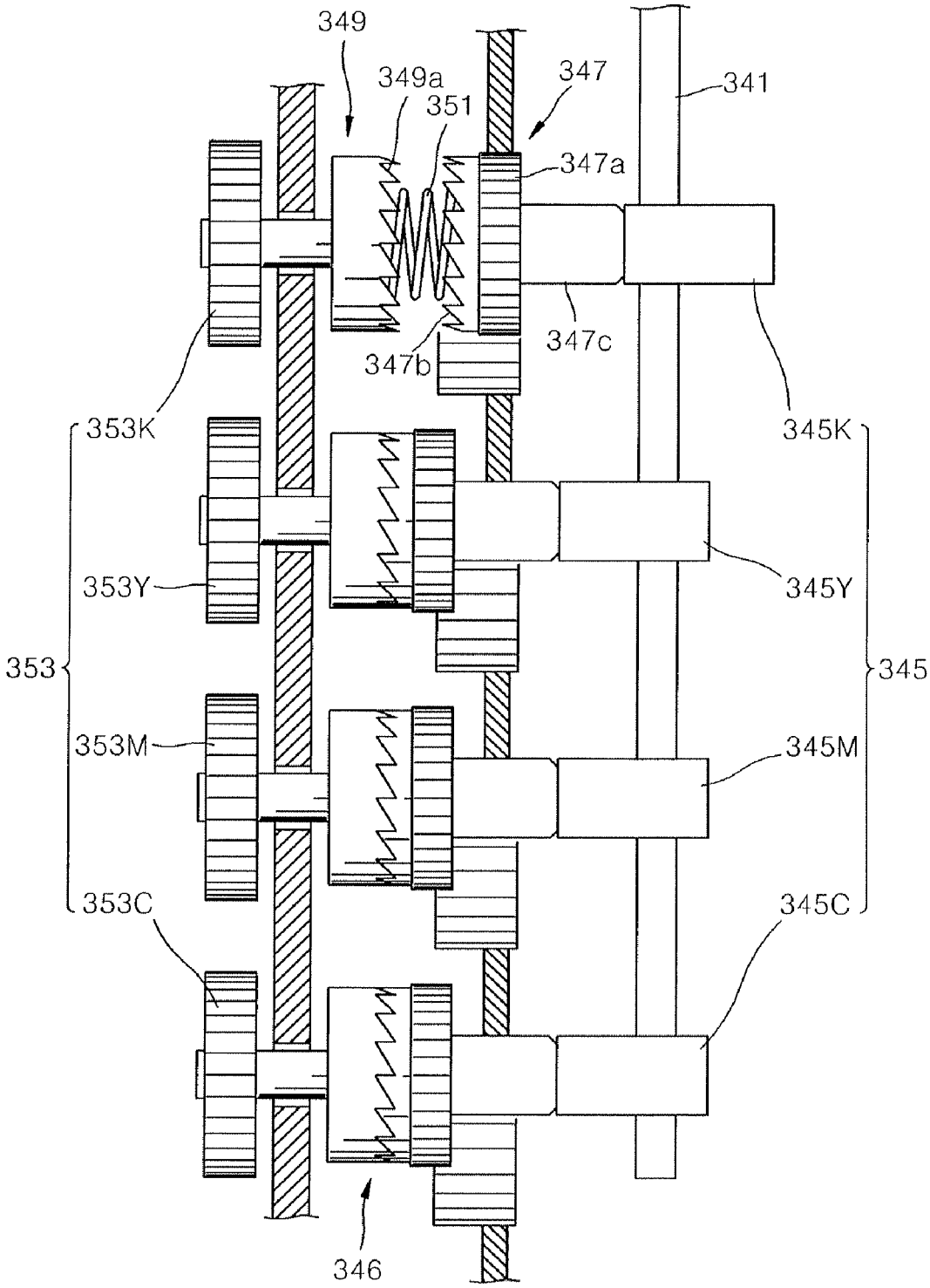
FIG. 9 is a schematic view illustrating a second power transmitter in FIG. 6

The fifth, sixth, seventh, and eighth cams 345C, 345M, 345Y and 345K are formed in different cam profiles. If at least one cam operates to transmit the power through the second coupler 346, some of the remaining cams operate to cut off the power. For example, if the second cam shaft 341 is positioned as shown in FIG. 9, the fifth to seventh cams 345C, 345M and 345Y are positioned to couple the second coupler 346, while the eighth cam 345K is positioned not to couple the second coupler 346.

The first cam 325C and the fifth cam 345C, the second cam 325M and the sixth cam 345M, the third cam 325Y and the seventh cam 345Y, and the fourth cam 325K and the eighth cam 345K respectively operate to drive the corresponding ones of the plurality of the developing units 200. If the power is transmitted to the developing part 210 through one of the first, second, third, and fourth cams 325C, 325M, 325Y and 325K, each of the fifth, sixth, seventh, and eighth cams 345C, 345M, 345Y and 345K may transmit the power to the toner supplying part 220 of the developing units 200 other than the developing unit 200 to which the power is transmitted to perform agitation. A vibration arising from the agitation may be prevented by stopping operation of the agitator of the toner supplying part 220 in the developing unit 200 which is performing the developing operation.

Figure 7:
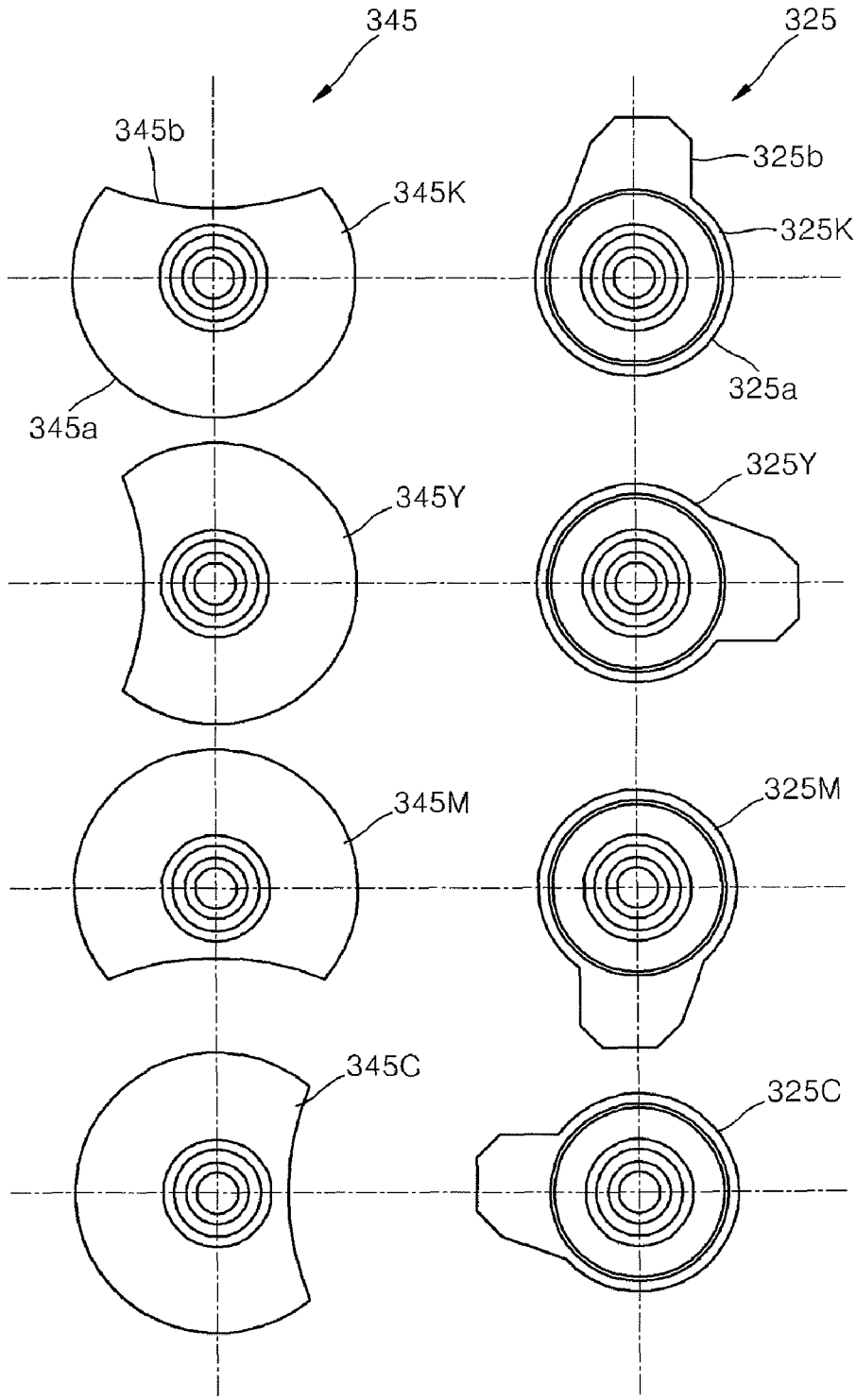
FIG. 7 illustrates a cam profile which is formed in first and second cam shafts in FIG. 6.

As illustrated in FIG. 7, if a cam projection of the fourth cam 325K is arranged in a direction (upper direction in FIG. 7) to press the first coupler 326, cam projections of the first, second, and third cams 325C, 325M and 325Y are arranged in other directions not to press the first coupler 326.

Referring to the profile of the fifth, sixth, seventh, and eighth cams 345C, 345M, 345Y and 345K, a concave portion of the eighth cam 345K corresponding to the fourth cam 325K is arranged toward the second coupler 346 (upper direction in FIG. 7), not to couple the second coupler 346. Meanwhile, since a curved surface of the fifth to seventh cams 345C, 345M and 345Y pressing the second coupler 346 is arranged toward the second coupler 346, the fifth to seventh cams 345C, 345M and 345Y makes the second couplers 346 to be engaged. If the fourth developing unit 200K is driven to develop a black image, the toner supplying part 220 of the fourth developing unit 200K stops a toner supplying operation and the toner supplying parts 220 within other developing units 200C, 200M and 200Y are driven to perform the toner supply operation.

The first coupler 326 is provided in plural to correspond to the first, second, third, and fourth cams 325C, 325M, 325Y and 325K in respective colors. The first couplers 326 are coupled to transmit the power to the developing parts 210 of the first, second, third, and fourth developing units 200C, 200M, 200Y and 200K.

The first couplers 326 each include first and second clutches 327 and 329, and a first elastic member 331 which is disposed between the first and second clutches 327 and 329.

The first clutch 327 is rotatably driven by the driving source 310 and slides in a shaft direction according to a rotating position of the cam 325 formed in the first cam shaft 321. More specifically, the first clutch 327 includes a first power receiver 327*a* which receives the power from the driving source 310, a first coupling part 327*b* which is coupled with the second clutch 329, and a first push cap 327*c* which contacts the cam 325 and pushes the first coupling part 327*b* toward the second clutch 329 according to a shape of the cam 325 and/or a relative position of the protrusion portion of the cam 325 with respect to the first coupler 326. The first clutch 327 may slide in the shaft direction and may be engaged with the second clutch 329 if the cam 325 pushes the first push cap 327*c*. The first power receiver 327*a* receives the power from the driving source 310 through a first transfer gear 311 to rotate the first clutch 327. The first power receiver 327*a* continues to receive the power by being connected with the driving source 310 even if the first clutch 327 reciprocates in the shaft direction. Thus, the first clutch 327 continuously rotates during the developing process.

The second clutch 329 includes a second coupling part 329*a* which is selectively coupled with the first coupling part 327*b*. The second clutch 329 selectively receives the power from the driving source 310 depending on the rotating position of the cam 325 to rotatably drive the developing roller 211 and the supplying roller 215.

The first elastic member 331 is disposed between the first and second clutches 327 and 329 to bias the first clutch 327 elastically. If the cam 325 stops pressing the first clutch 327, the first elastic member 331 elastically biases the first clutch 327 toward the cam 325 to decouple the first and second clutches 327 and 329.

The first driver 333 is provided in the same shaft as the second clutch 329. The first driver 333 receives the power from the driving source 310 and drives the developing part 210 if the first couplers 326 are coupled. That is, the first driver 333 includes four drivers 333C, 333M, 333Y and 333K corresponding to the first, second, third, and fourth developing units 200C, 200M, 200Y and 200K. The first driver 333 drives the developing roller 211 and the supplying roller 215 through the first interlocking gear 335 or by directly being engaged with the rotating gears 337*a* and 337*b*.

The second coupler 346 is provided in plural to correspond to the fifth, sixth, seventh, and eighth cams 345C, 345M, 345Y and 345K in respective colors. The second couplers 346 are provided to transmit the power to the toner supplying part 220 of the first, second, third, and fourth developing units 200C, 200M, 200Y and 200K.

The second coupler 346 includes third and fourth clutches 347 and 349 and a second elastic member 351 which is disposed between the third and fourth clutches 347 and 349.

The third clutch 347 is rotatably driven by the driving source 310, and slides in a shaft direction depending on a rotating position of the cam 345 formed in the second cam shaft 341. More specifically, the third clutch 347 includes a second power receiver 347*a* which receives the power from the driving source 310, a third coupling part 347*b* which is coupled with the fourth clutch 349, and a second push cap 347*c* which contacts the cam 345 and pushes the third coupling part 347*b* to the fourth clutch 349 according to a relative position of the curved surface of the cam 345 with respect to the second coupler 346. The third clutch 347 may slide in the shaft direction to be engaged with the fourth clutch 349 if the cam 345 pushes the second push cap 347*c*. That is, a curved surface of the cam 345 corresponds to the second push cap 347. Here, the second power receiver 347*a* receives the power from the driving source 310 through a second transfer gear 315 to rotate the third clutch 347. The second power receiver 347*a* continues to receive the power by being connected with the driving source 310 even if the third clutch 347 reciprocates in the shaft direction. Thus, the third clutch 347 continuously rotates during the developing process of the developing unit 200.

The fourth clutch 349 includes a fourth coupling part 349*a* which is selectively coupled with the third coupling part 347*b*. The fourth clutch 349 selectively receives the power from the driving source 310 according to the rotating position of the cam 345 with respect to the third clutch 347 to drive the toner supplying part 220.

The second elastic member 351 is disposed between the third and fourth clutches 347 and 349, and biases the third clutch 347 elastically. If the cam 345 stops pressing the third clutch 347, that is, a concave portion of the cam 345 corresponding the second push cap 347 of the third clutch 347, the second elastic member 351 elastically biases the third clutch 347 toward the cam 345 to decouple the third and fourth clutches 347 and 349.

The second driver 353 is provided in the same shaft as the fourth clutch 349. The second driver 353 receives the power from the driving source 310 and drives the toner supplying part 220 if the second coupler 346 is coupled. That is, the second driver 353 includes four drivers 353C, 353M, 353Y and 353K corresponding to the first, second, third, and fourth developing units 200C, 200M, 200Y and 200K. The second driver 353 drives the toner supplying part 220 directly, or through the second interlocking gear 355.

The developing unit driving apparatus 300 according to the present general inventive concept may further include a cam driver 360 which adjusts the rotating position of the cams 325 and 345, and a interlocking member 370 which allows the first and second cam shafts 321 and 341 to rotate in interlocking with each other by the power from the cam driver 360.

The cam driver 360 rotates the first cam shaft 321 or the second cam shaft 341 to adjust the position of the cams 325 and 345. FIG. 6 illustrates an example of the cam driver 360 which is provided in the first cam shaft 321.

As illustrated therein, the cam driver 360 includes a solenoid 361, a latch member 363 which is provided in the same axis as the first cam shaft 321, and a one-way clutch 365 which controls one-way rotation of the first cam shaft 321. The latch member 363 rotates by a reciprocation of the solenoid 361, thereby rotatably driving the first cam shaft 321.

An interlocking member 370 includes a first interlocking gear 371 and a second interlocking gear 375 which are respectively provided at a position corresponding to the first and second cam shafts 321 and 341. If the first cam shaft 321 rotates by the cam driver 360, the second cam shaft 341 rotates together with the first cam shaft 321.

The developing unit driving apparatus 300 may further include a groove mark 381 which is formed in the first cam shaft 321 or the second cam shaft 345, and a position sensor 385 which detects a rotating position of the groove mark 381, to determine the position of the cams 325 and 345. The position sensor 385 includes a light emitting element and a light receiving element. The position of the cams 325 and 345 is initialized depending on whether a light blocking part 381*a* formed in the groove mark 381 is provided in the position sensor 385.

Hereinafter, a method of driving the developing unit 200 having the foregoing configuration will be described in detail.

The method of driving the developing unit according to the exemplary embodiment of the present general inventive concept is divided into first and second stages.

At the first stage, the developing unit 200 performs the developing operation and the power supplied to the toner supplying part 220 is cut off while the developing part 210 is driven. At the second stage, the toner supplying part 220 is driven by the power except when the developing part 210 is driven.

The first stage can be divided into two sub stages in detail.

At a first sub-stage of the first stage, the first cam shaft 321 is rotatably driven to couple the first couplers 326 by the profile of the cam 325. The first cam shaft 321 has the cam 325 including the predetermined profile in the circumference thereof. Thus, the developing part 210 is driven by the power from the driving source 310. At a second sub-stage of the first stage, the second cam shaft 341 is rotatably driven to decouple the second coupler 346 by the profile of the cam 345 formed in the second cam shaft 341. The second cam shaft 341 includes the cam 345 having the predetermined profile in the circumference thereof. Thus, the power supplied to the toner supplying part 220 is cut off.

The second stage is divided into two sub-stages as following.

At a first sub-stage of the second stage, the first cam shaft 321 is rotatably driven to decouple the first couplers 326 by the profile of the cam 325, thereby cutting off the power supplied to the developing part 210. The first cam shaft 321 has the cam 325 including the predetermined profile in the circumference thereof.

At a second sub-stage of the second stage, the second cam shaft 341 is rotatably driven. The second coupler 346 is coupled by the profile of the cam 345 formed in the second cam shaft 341. Thus, the toner supplying part 220 is driven by the power from the driving source 310.

As illustrated in FIG. 3, the developing unit 200 may include the plurality of developing units 200C, 200M, 200Y and 200K which respectively develops the toner of a predetermined color. The first and second stages above are respectively performed in the developing part 210 and the toner supplying part 220 of one of the developing units 200C, 200M, 200Y and 200K.

In the present general inventive concept, the first cam shaft 321 or the second cam shaft 341 may rotate by the cam driver 360 to adjust the position of the cams 325 and 345. Also, the first and second cam shafts 321 and 341 may rotate in interlocking with each other by the power supplied from the cam driver 360.

As described above, the present general inventive concept provides an apparatus and a method of driving a developing unit driving apparatus which lowers vibration of a developing unit by stopping driving a supplying part during a developing process to drive a developing part and by driving a supplying part during a toner supplying process when the developing part is not driven. Thus, developing errors may reduce.

As described above, a developing unit driving apparatus includes a first cam to drive a developing part, a second cam to drive a toner supplying part. The first cam includes a first profile of a circular portion and a protrusion. The second cam includes a second profile of a curved surface and a concave portion. When the circular portion of the first cam couples to the first coupler, the concave portion of second cam decouples the second coupler.

Also, the developing unit driving apparatus according to the present general inventive concept improves a cam driving configuration and independently transmits power to a developing part and a toner supplying part without an additional control configuration if being employed in an image forming apparatus which sequentially drives a plurality of developing units. If the developing unit driving apparatus is employed in an image forming apparatus which employs four developing units, when a single developing unit performs a developing operation, supplying parts of other three developing units are simultaneously driven, thereby securing long toner-supplying time and improving efficiency in supplying a toner.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A developing unit driving apparatus which drives a developing unit having a toner cartridge to, accommodate a toner, a developing part disposed in the toner cartridge to develop the toner to a photosensitive body, and a toner supplying part provided in the toner cartridge to supply the toner to the developing part, the apparatus comprising:

a driving source;

a first power transmitter which transmits power supplied from the driving source to the developing part when driven in a first direction; and a second power transmitter which transmits the power supplied from the driving source to the toner supplying part when driven in the first direction except when the developing part is driven by the first power transmitter.

2. The apparatus according to claim 1, wherein the first power transmitter comprises:

a first cam shaft which has a cam formed on a circumference thereof;

a first coupler which is selectively coupled by a profile of the cam; and a first driver which is provided between the first coupler and the developing part, and receives the power from the driving source through the first coupler to drive the developing part if the first coupler is coupled.

3. The apparatus according to claim 2, further comprising:

a groove mark which is formed in the first cam shaft; and a position sensor which detects a rotating position of the groove mark so as to adjust a relative position of the first cam shaft with respect to the first coupler.

4. The apparatus according to claim 2, wherein the second power transmitter comprises:

a second cam shaft which has a cam formed on a circumference thereof;

a second coupler which is selectively coupled by a profile of the cam; and a second driver which is provided between the second coupler and the toner supplying part, and receives the power from the driving source through the second coupler to drive the toner supplying part if the second coupler is coupled.

5. The apparatus according to claim 4, further comprising:

a cam driver which rotates the first cam shaft or the second cam shaft and adjusts a position of the cam; and an interlocking member which is formed at a position corresponding to the first and second cam shafts for the first and second cam shafts to interlock the first and second shafts by the power supplied from the cam driver.

6. The apparatus according to claim 4, further comprising:

a groove mark which is formed in one of the first cam shaft and the second cam shaft; and a position sensor which detects the rotating position of the groove mark, so as to adjust a relative position between the other one of the first cam shaft and the second cam shaft and a corresponding one of the first coupler and the second coupler.

7. The apparatus according to claim 4, wherein the first and second couplers respectively comprise:

a first clutch which is rotatably driven by the driving source and slides in a shaft direction depending on a rotating position of the cam;

a second clutch which is coupled to the first clutch in the shaft direction, and selectively engaged with the first clutch depending on the rotating position of the cam to drive the developing unit; and an elastic member which is disposed between the first and second clutches to elastically bias the first clutch.

8. The apparatus according to claim 7, wherein the first clutch comprises;

a first power receiver which receives power from the driving source;

a first coupling part which is coupled with the second clutch; and a push cap which selectively moves by the profile of the cam and pushes the first coupling part in the second clutch direction.

9. The apparatus according to claim 8, wherein the second clutch comprises a second coupling part which is selectively coupled with the first coupling part.

10. The apparatus according to claim 1, wherein the developing unit comprises a plurality of developing units which respectively develop a toner of a predetermined color, the first power transmitter transmits the power to the developing part of each of the plurality of developing units in a predetermined sequence, and the second power transmitter transmits the power to the toner supplying part of each of the plurality of developing units in a predetermined sequence.

11. The apparatus according to claim 10, wherein the first power transmitter comprises:

a first cam shaft which has, in a circumference thereof, a plurality of cams provided corresponding to the plurality of developing units, and having different cam profiles;

a plurality of first couplers which is provided corresponding to the respective developing units and selectively coupled by the cam profile of the plurality of cams; and a plurality of first drivers which are respectively provided between the plurality of first couplers and corresponding ones of the plurality of developing parts, and receives the power from the driving source through the coupled first coupler among the plurality of first couplers to drive the corresponding developing part.

12. The apparatus according to claim 11, wherein the second power transmitter comprises:

a second cam shaft which rotates in interlocking with a rotation of the first cam shaft, and has, in a circumference thereof, a plurality of cams provided corresponding to the plurality of developing units, and comprising different cam profiles;

a plurality of second couplers which is provided corresponding to the respective developing units and selectively coupled by a cam profile of a cam formed in the second cam shaft; and a plurality of second drivers which are respectively provided between the plurality of second couplers and corresponding ones of the plurality of toner supplying parts, and receives the power from the driving source through the coupled second coupler among the plurality of second couplers to drive the toner supplying part.

13. The apparatus according to claim 12, further comprising;

a cam driver which rotates the first cam shaft or the second cam shaft and adjusts a position of the cam; and an interlocking member which is provided corresponding to the first and second cam shafts for the first and second cam shafts to interlock the first and second shafts by the power supplied from the cam driver.

14. The apparatus according to claim 13, further comprising:

a groove mark which is formed in one of the first cam shaft and the second cam shaft; and a position sensor which detects a rotating position of the groove mark, so as to adjust a relative position between one of the first cam shaft and the second cam shaft and a corresponding one of the first coupler and the second coupler.

15. The apparatus according to claim 12, wherein the plurality of first and second couplers respectively comprise:

a first clutch which is rotatably driven by the driving source, and slides in a shaft direction according to a rotating position of the cam;

a second clutch which is disposed in the shaft direction and selectively engaged with the first clutch depending on the rotating position of the cam to drive the toner supplying unit; and an elastic member which is disposed between the first and second clutches to elastically bias the first clutch.

16. The apparatus according to claim 15, wherein the first clutch comprises:

a first power receiver which receives the power from the driving source;

a first coupling part which is coupled with the second clutch; and a push cap which selectively moves by the profile of the cam and pushes the first coupling part to the second clutch.

17. The apparatus according to claim 16, wherein the second clutch comprises a second coupling part which is selectively coupled with the first coupling part.

18. A method of driving a developing unit which comprises a toner, cartridge accommodating a toner, a developing part disposed in the toner cartridge to develop the toner to a photosensitive body, and a toner supplying part disposed in the toner cartridge to supply the toner to the developing part, the method comprising:

driving the developing part by using a first power transmitter and cutting off the power supplied to the toner supplying part if a developing process is performed through the developing unit, in a first stage; and transmitting the power supplied from a driving source to the toner supplying part by using a second power transmitter to drive the toner supplying part except when the developing part is driven, in a second stage, wherein the developing part and the toner supplying part are driven by driving the driving source in a first direction.

19. The method according to claim 18, wherein the developing unit comprises a plurality of developing units which respectively develop a toner of a predetermined color;

the first and second stages are respectively performed in the developing part and the toner supplying part of one of the plurality of developing units, and the transmitting of the power comprises transmitting the power to the developing unit and transmitting the power to the toner supplying unit except when a corresponding one of the developing units is driven.

20. The method according to claim 18, wherein the first stage comprises:

rotating and driving a first cam shaft having a cam including a predetermined profile in a circumference thereof and driving the developing part by the power supplied from the driving source by coupling the first coupler by the cam profile; and rotatably driving a second cam shaft having a cam including a predetermined profile in a circumference thereof and cutting off the power supplied to the toner supplying part by decoupling the second coupler by the cam profile formed in the second cam shaft.

21. The method according to claim 20, further comprising:

adjusting a position of the cam by rotating the first cam shaft or the second cam shaft by the cam driver; and rotating the first and second cam shaft in interlocking with each other by the power supplied from the cam driver.

22. The method according to claim 18, wherein the second stage comprises:

rotatably driving a first cam shaft having a cam including a predetermined profile in a circumference thereof and cutting off the power supplied to the developing part by decoupling the first coupler by a profile of the cam formed in the first cam shaft; and rotatably driving a second cam shaft having a cam including a predetermined profile in a circumference thereof and driving the toner supplying part by the power supplied from the driving source by coupling the second coupler by the cam profile.

23. The method according to claim 22, further comprising:

adjusting a position of the cam by rotating the first cam shaft or the second cam shaft by the cam driver; and rotating the first and second cam shaft in interlocking with each other by the power supplied from the cam driver.

24. An image forming apparatus, comprising:

a photosensitive body;

a light scanning unit which scans a light beam to form an electrostatic latent image in the photosensitive body;

a developing unit which comprises a toner cartridge to accommodate a toner, a developing part disposed in the toner cartridge to develop the electrostatic latent image of the photosensitive body with the toner, and a toner supplying part disposed in the toner cartridge to supply the toner to the developing part in a developing part direction;

a developing unit driving apparatus having a driving source, a first power transmitter which transmits power supplied from the driving source to the developing part, and a second power transmitter which transmits the power supplied from the driving source to the toner supplying part except when the developing part is driven by the first power transmitter;

a transfer unit which transfers a toner image formed in the photosensitive body to a printing medium; and a fusing unit which fuses the image transferred to the printing medium, wherein the developing part and the toner supplying part are driven by driving the driving source in a first direction.

25. The image forming apparatus according to claim 24, wherein the first power transmitter comprises:

a first cam shaft which has a cam formed on a circumference thereof;

a first coupler which is selectively coupled by a profile of the cam; and a first driver which is provided between the first coupler and the developing part, and receives the power from the driving source through the first coupler to drive the developing part if the first coupler is coupled.

26. The image forming apparatus according to claim 25, further comprising:

a groove mark which is formed in the first cam shaft, and a position sensor which detects a rotating position of the groove mark, so as to adjust a relative position of the first cam shaft with respect to the first coupler according to the detected rotation position.

27. The image forming apparatus according to claim 25, wherein the second power transmitter comprises:

a second cam shaft which has a cam formed on a circumference thereof;

a second coupler which is selectively coupled by a profile of the cam, and a second driver which is provided between the second coupler and the toner supplying part, and receives the power from the driving source through the second coupler to drive the toner supplying part if the second coupler is coupled.

28. The image forming apparatus according to claim 27, further comprising:

a cam driver which rotates the first cam shaft or the second cam shaft and adjusts a position of the cam; and an interlocking member which is formed at a position corresponding to the first and second cam shafts for the first and second cam shafts to interlock the first and second shafts by the power supplied from the cam driver.

29. The image forming apparatus according to claim 27, further comprising:

a groove mark which is formed in one of the first cam shaft and the second cam shaft; and a position sensor which detects the rotating position of the groove mark, so as to adjust a relative position between the other one of the first cam shaft and the second cam shaft and a corresponding one of the first coupler and the second coupler.

30. The image forming apparatus according to claim 27, wherein the first and second couplers respectively comprise:

a first clutch which is rotatably driven by the driving source and slides in a shaft direction depending on the rotating position of the cam;

a second clutch which is coupled to the first clutch in the shaft direction, and selectively engaged with the first clutch depending on the rotating position of the cam to drive the developing unit; and an elastic member which is disposed between the first and second clutches to elastically bias the first clutch.

31. The image forming apparatus according to claim 30, wherein the first clutch comprises:

a first power receiver which receives power from the driving source;

a first coupling part which is coupled with the second clutch; and a push cap which selectively moves by the profile of the cam and pushes the first coupling part in the second clutch direction.

32. The image forming apparatus according to claim 31, wherein the second clutch comprises a second coupling part which is selectively coupled with the first coupling part.

33. The image forming apparatus according to claim 24, wherein the developing unit comprises a plurality of developing units which respectively develop an image with a toner of a predetermined color, the first power transmitter transmits the power to the developing part of each of the plurality of developing units in a predetermined sequence, and the second power transmitter transmits the power to the toner supplying part of each of the plurality of developing units in a predetermined sequence.

34. The image forming apparatus according to claim 3, wherein the first power transmitter comprises:

a first cam shaft which has, in a circumference thereof, a plurality of cams provided corresponding to the plurality of developing units, and having different cam profiles;

a plurality of first couplers which are provided corresponding to the respective developing units and selectively coupled by the cam profile of the plurality of cams; and a plurality of first drivers which is respectively provided between the plurality of first couplers and corresponding ones of the plurality of developing parts, and receives the power from the driving source through the coupled first coupler among the plurality of first couplers to drive the corresponding developing part.

35. The image forming apparatus according to claim 34, wherein the second power transmitter comprises:

a second cam shaft which rotates in interlocking with a rotation of the first cam shaft, and has, in a circumference thereof, a plurality of cams provided corresponding to the plurality of developing units, and comprising different cam profiles;

a plurality of second couplers which is provided corresponding to the respective developing units and selectively coupled by a cam profile of a cam formed in the second cam shaft; and a plurality of second drivers which are respectively provided between the plurality of second couplers and corresponding ones of the plurality of toner supplying parts, and receives the power from the driving source through the coupled second coupler among the plurality of second couplers to drive the toner supplying part.

36. The image forming apparatus according to claim 35, further comprising:

a cam driver which rotates the first cam shaft or the second cam shaft and adjusts a position of the cam; and an interlocking member which is provided corresponding to the first and second cam shafts for the first and second cam shafts to interlock the first and second cam shafts by the power supplied from the cam driver.

37. The image forming apparatus according to claim 36, further comprising:

a groove mark which is formed in one of the first cam shaft and the second cam shaft; and a position sensor which detects a rotating position of the groove mark wherein a relative position between one or the first cam shaft and the second cam shaft and a corresponding one of the first coupler and the second coupler.

38. The image forming apparatus according to claim 35, wherein the plurality of first and second couplers respectively comprise:

a first clutch which is rotatably driven by the driving source, and slides in a shaft direction according to a rotating position of the cam;

a second clutch which is disposed in the shaft direction and selectively engaged with the first clutch depending on the rotating position of the cam to drive the toner supplying unit; and an elastic member which is disposed between the first and second clutches to elastically bias the first clutch.

39. The image forming apparatus according to claim 38, wherein the first clutch comprises:

a first power receiver which receives the power from the driving source;

a first coupling part which is coupled with the second clutch; and a push cap which selectively moves by the profile of the cam and pushes the first coupling part to the second clutch.

40. The image forming apparatus according to claim 39, wherein the second clutch comprises a second coupling part which is selectively coupled with the first coupling part.

41. A developing unit driving method of a developing unit driving apparatus usable with an image forming apparatus, the method comprising:

transmitting power supplied from a driving source to a developing part using a first transmitter; and transmitting the power supplied from the driving source to a toner supplying part using a second transmitter so as to supply the toner to the developing unit except when the developing part is driven by the first power transmitter, wherein power is transmitted to the developing part and the toner supplying part when the driving source is driven in a first direction.

42. A developing unit driving apparatus usable with an image forming apparatus, the apparatus comprising:

a developing part to supply a toner an image;

a toner supply part to supply the toner to the developing part; and a driving unit to selectively drive the toner supplying part according to an operation position of the developing part.

43. A developing unit driving apparatus usable with an image forming apparatus, the apparatus comprising:

a driving source;

a developing part to supply a toner to form an image;

a toner supply part to supply the toner to the developing part;

a first cam disposed between the driving source and the developing part to drive the developing part; and a second cam disposed between the driving source and the toner supply part to selectively drive the toner supply part according to a position of the first cam with respect to the developing part.

* * * * *